United States Patent [19]

Ponchak

[11] Patent Number: 4,817,953

[45] Date of Patent: Apr. 4, 1989

[54] PORTABLE TRAINING DEVICE FOR GOLFERS

[76] Inventor: Anthony Ponchak, 1161 Packer Cir., Tustin, Calif. 92680

[21] Appl. No.: 59,309

[22] Filed: Jun. 8, 1987

[51] Int. Cl.[4] ..... A63B 69/36

[52] U.S. Cl. ..... 273/188 R; 206/315.1

[58] Field of Search ..... 273/188 R, 188 A, 188 B, 273/189 R, 189 A, 190 R, 190 A, 190 B, 183 B

[56] References Cited

U.S. PATENT DOCUMENTS

| | | | |
|---|---|---|---|
| 1,918,350 | 7/1933 | Roos | 273/188 R |
| 3,079,152 | 2/1963 | Cushing | 273/183 B |
| 3,606,341 | 9/1971 | Honbarger | 273/188 R |
| 3,614,107 | 10/1971 | Kinsey | 273/188 A |
| 3,880,431 | 4/1975 | Swanson | 273/183 B |
| 3,955,821 | 5/1976 | Spedding | 273/187 B |
| 4,088,326 | 5/1978 | Bifulco | 273/188 R |
| 4,103,897 | 8/1978 | Ostyn | 273/188 A |
| 4,106,771 | 8/1978 | Fern | 273/183 B |
| 4,147,356 | 4/1979 | Brandell | 273/188 A |
| 4,516,772 | 5/1985 | Stratton | 273/188 A |
| 4,651,994 | 3/1987 | Lee | 273/188 R |

*Primary Examiner*—George J. Marlo
*Attorney, Agent, or Firm*—Leonard Tachner

[57] ABSTRACT

A golfer's training device comprises three generally rectangular elongated sections interconnected by a pair of full length hinge members which permit the three folded sections to be unfolded to provide a straight or substantially straight planar member which may be readily situated adjacent the golfer's load bearing leg while he is addressing the ball for effectively forcing the golfer to properly control the position of his load bearing leg during the golf stroke. A pair of extendable stakes are secured to the outlying foldable sections to provide means for securing the invention into the turf in proper position relative to the golfer.

6 Claims, 1 Drawing Sheet

PORTABLE TRAINING DEVICE FOR GOLFERS

BACKGROUND OF THE INVENTION

1. Field of the Invention

The present invention relates generally to an apparatus for use in training golfers and more specifically, to a portable device which may be used advantageously by golfers to improve the character of their golf swing.

2. Prior Art

A variety of various devices have been disclosed in the prior art for effectively forcing a golfer to use the correct stance in addressing the ball and in actually swinging and stroking the ball during the play of the game. By way of example, the following patents disclose various devices for accomplishing the aforementioned objectives or objectives similar thereto:

U.S. Pat. No. 1,918,350, Roos
U.S. Pat. No. 3,079,152, Cushing
U.S. Pat. No. 3,606,341, Honbarger
U.S. Pat. No. 3,614,107, Kinsey
U.S. Pat. No. 3,880,431, Swanson
U.S. Pat. No. 3,955,821, Spedding
U.S. Pat. No. 4,088,326, Bifulco
U.S. Pat. No. 4,103,897, Ostya
U.S. Pat. No. 4,106,771, Fern
U.S. Pat. No. 4,147,356, Brandell U.S. Pat. No. 1,918,350 to Roos, which appears to be the most relevant, is directed to what is termed a foot holder, and is used by golfers. The rear portion of the rest has a recess which receives against its wall the shoe of the player. The device is used as a guide for the foot of the player and the foot is prevented from slipping or twisting in order to maintain the proper stance during the golfing swing.

U.S. Pat. No. 4,147,356 to Brandell is directed to a golf swing practice device which includes a foot rest and a U-shaped member or brace mounted thereon and projecting upwardly. When the golfer is using the device, he places his rear foot on the foot rest adjusted to a proper position where a member engages the right leg. This device apparently can be mounted on a rubber surface where the foot supporting surface has corrugations to afford a roughened surface to assist in preventing slipping when the golfer is standing on it.

U.S. Pat. No. 3,955,821 to Spedding is directed to a training device and includes a leg rest 21 which has the extremities mounted to the sides. The leg rest is adapted to be held in an erected position by a stop and locking pin. The leg rest bears against the outside surface of the leg of a golfer and restricts outward movement of the golfer's leg relative to a foot rest.

U.S. Pat. No. 3,606,341 to Honbarger is directed to a golfer's foot holding device which includes a pliable member. The member is folded on itself at the mid-portion and at the end portions there is Velcro so that a closed contour can be formed as shown in FIG. 4. The golfer's foot fits within the opening and is held by the system which is staked into the ground by the spike.

SUMMARY OF THE INVENTION

The present invention provides certain distinctive features as compared to the above-noted prior art those features producing a number of advantages relating to ease of use and effectiveness. The principal advantage of the present invention resides in its ease of use. More specifically, the present invention is provided in the form of a portable, foldable training device having an appropriate shape when folded to easily fit within a typical golf bag for ease of conveyance. Furthermore, the present invention provides a pair of built-in stakes which are designed to be embedded in the turf adjacent the teeing area when unfolded to provide the golfer with ease of implementation and a minimum of distraction from his game while still meeting the objective of controlling the position of the golfer's weight bearing leg during the stroking action.

A disclosed embodiment of the invention comprises three generally rectangular elongated sections interconnected by a pair of full length hinge members which permit the three folded sections to be unfolded to provide a straight or substantially straight planar member which may be readily situated adjacent the golfer's load bearing leg while he is addressing the ball for effectively forcing the golfer to properly control the position of his load bearing leg during the golf stroke. A pair of extendable stakes are secured to the outlying foldable sections to provide means for securing the invention into the turf in proper position relative to the golfer. Although the present invention is adapted primarily for use on the practice range the golfer derives the principal advantage of the present invention while he actually plays the game. The unique configuration of the present invention permits it to be readily adapted to use on rubber mats by means of holding straps which enables its use during practice in environments where a soft turf-like surface is not available. Most notably however, the present invention provides a golfer training device which is convenient to carry and set up thereby obviating the prior art complexities and inconveniences which would otherwise tend to dissuade the golfer from using the device which is of course necessary to derive its benefit. Generally speaking, the more the training the device of the present invention is utilized in practice and play, the more quickly the benefits will be derived therefrom, more specifically, the more quickly the golfer's swing will be improved and his golfing score should improve.

OBJECTS OF THE PRESENT INVENTION

It is therefore a principal object of the present invention to provide a golfer training apparatus of a foldable configuration which may be readily carried in the golfer's golf bag and conveniently unfolded and placed in position for use during practice of the golf swing.

It is an additional object of the present invention to provide a golf training apparatus of a portable configuration which is adapted to be used both on soft turf-like surfaces as well as harder surfaces in conjunction with rubber mats and the like.

It is still an additional object of the present invention to provide a golf training apparatus which need not be secured to the golfer, which is light enough to be carried by the golfer and Which provides means for securing it in a folded configuration so that it may be placed inside a standard golf bag for being carried therein along with the golf clubs to the practice range.

BRIEF DESCRIPTION OF THE DRAWINGS

The aforementioned objects and advantages of the present invention as well as additional objects and advantages thereof will be more fully understood hereinafter as a result of a detailed description of a preferred embodiment of the invention when taken in conjunction with the following drawings in which.

DETAILED DESCRIPTION OF A PREFERRED EMBODIMENT

Figure 1:
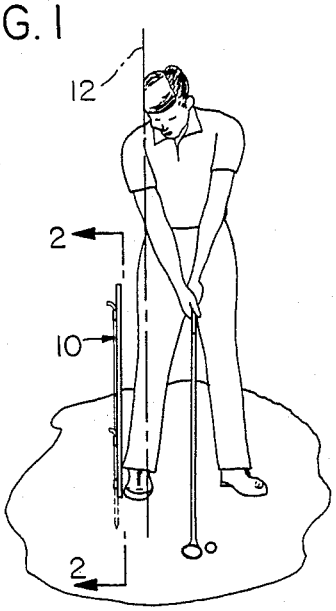
FIG. 1 is a three-dimensional view illustrating the use of the present invention by a golfer in a position addressing the ball for stroking same.

Referring first to FIG. 1 it will be seen that the training device 10 of the present invention is positioned vertically adjacent the golfer's load bearing leg as the golfer addresses the ball for stroking same. The vertical orientation and configuration of the training device 10 effectively defines an axis 12 spaced from the training device. The training device and the axis form a region in which the load bearing leg of the golfer is effectively confined during the swing whereby to cause the golfer to keep his load bearing leg, straight and parallel to the training device during the entire swing. Initially the golfer sets his load bearing foot in a position adjacent the bottom of the training device 10 so that when his body rotates, the upper portion of his leg will barely come in contact with the training device, permitting the golfer to sense the desired limit of leg and body movement to force him into an optimum golf swing position. Although the present invention is designed for such convenience and ease of use that it may be a permanent fixture for the golfer, it is contemplated that eventually the use of the training device will be obviated after the golfer has trained himself to limit his body motion to the desired extent limited by the training device.

Figure 2:
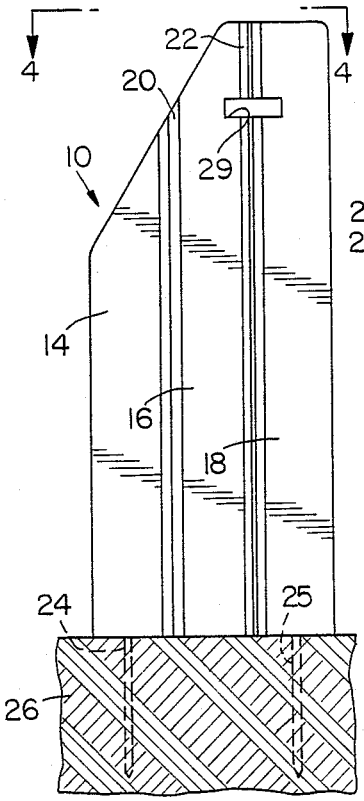
FIG. 2 is a planar front view of the invention fully deployed and embedded in a soft turf-like surface.
Figure 3:
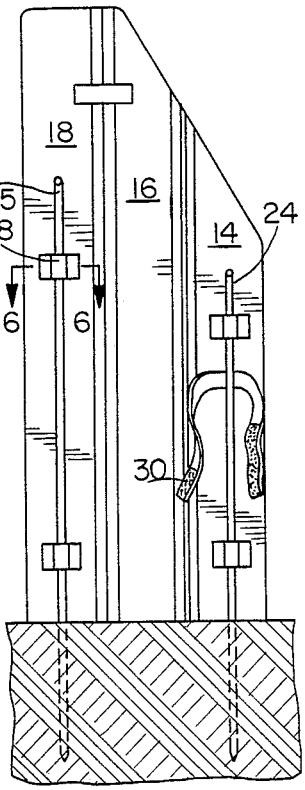
FIG. 3 is a planar rear view of the invention fully deployed as in FIG. 2.
Figure 5:
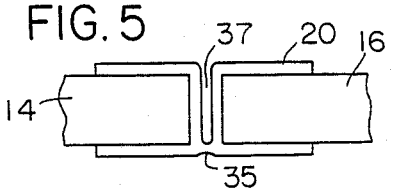
FIG. 5 is an enlarged view of the hinge member of the present invention taken from the circle labeled 5 in FIG. 4.
Figure 7:
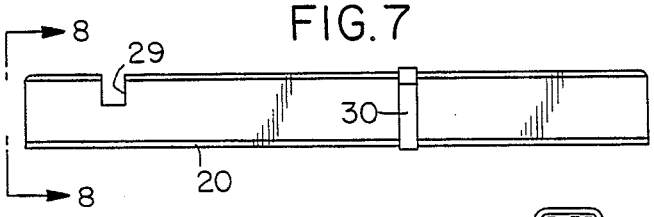
FIG. 7 is a planar view of the present invention shown in its fully folded configuration.

As seen best in FIGS. 2 and 3 the training device 10 of the present invention provides three equal width sections 14, 16 and 18 each of a generally rectangular configuration except sections 14 and 16 which are truncated at their upper edges along a diagonal to minimize the probability of interfering with the golf club during the swing. The three sections 14, 16 and 18, which are typically less than six inches in width, are interconnected by a pair of hinge members 20 and 22 which are oppositely facing in order to permit opposite folding in the manner shown in FIG. 7. As seen in cross-section in FIG. 5, each hinge member 20 and 22 is provided with an elongated score line 35 on one side and an elongated gap from that one side to the other side in order to permit folding in one direction. The hinge members may be press fit to the sections or otherwise adhesively secured thereto in a conventional manner. Hinge member 22 is provided with an aperture 29 which extends onto sections 16 and 18 and which forms a notch 29 seen in FIG. 7 when the training device 10 of the present invention is in its fully folded configuration. Notch 29 provides a convenient means for grasping the folded training device while it is in a golf bag or in the ground in order to further enhance its ease of use.

Figure 4:
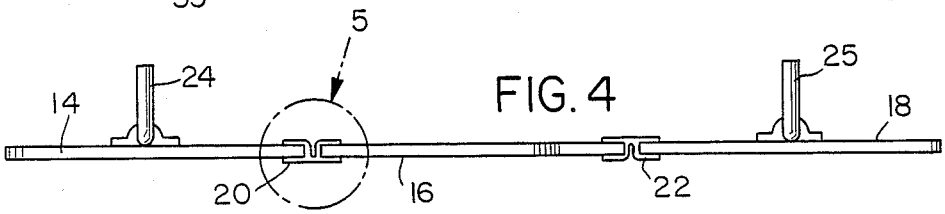
FIG. 4 is a top view of the invention taken along lines 4—4 of FIG. 2.
Figure 6:
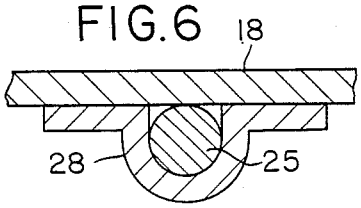
FIG. 6 is a cross-sectional view of a stake retention member taken along lines 6—6 of FIG. 3.

The training device is provided with a pair of stakes 24 and each in turn supported on respective sections 14 and 18 by a pair of stake retention members 28. Retention members 28 are preferably of a smooth surface material such as TEFLON and the like, permitting the stakes to be slid vertically along respective sections 14 and 18 to deploy same. As seen best in FIGS. 2 and 3, the stakes 24 and 25 have pointed bottom ends which enable easy penetration of the underlying soft turf-like surface 26 for deployment of the training device in a stable configuration. The top ends of stakes 24 and 25 are preferably folded 90 degrees as seen best in FIG. 4 in order to provide a convenient compressable surface to permit the golfer to force the stakes into the turf by simply engaging the stakes with the palm of his hand. A strap 30 is preferably provided beneath stake 24 to permit an easy and convenient means for securing the training device 10 in its folded configuration as seen best in FIG. 7. Strap 30 is preferably provided with an adhesive type end at each end such as male and female Velcro surfaces.

Figure 9:
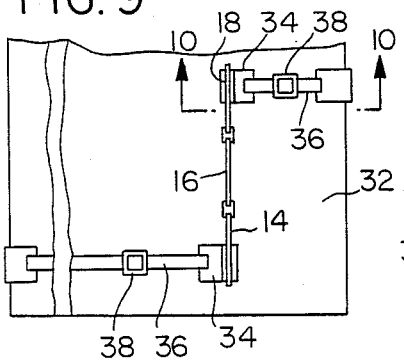
FIGS. 9 and 10 are top and side views respectively of the present invention shown supported by retention straps for use on floor mats or other such typical practice surfaces.
Figure 10:
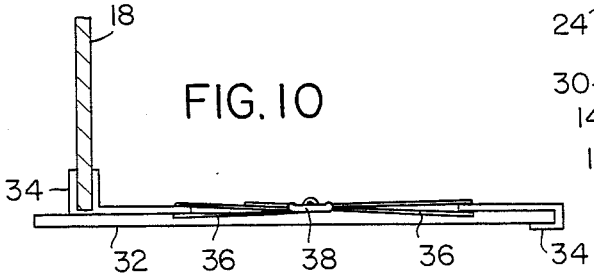
Figure 8:
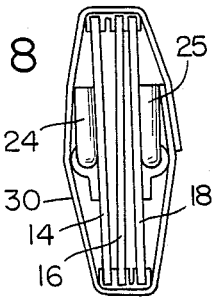
FIG. 8 is a top view of the fully folded configuration of the present invention taken along lines 8—8 of FIG. 7.

The present invention may also be readily secured to other surfaces. For example, as illustrated in FIGS. 9 and 10 the present invention may be secured to a mat such as a rubber mat 32 normally found in the teeing area of practice facilities. The training device 10 of the present invention may be readily secured to such mats by means of brackets 34, strap 36 and adjustable buckles 38 shown in the top view of FIG. 9 and the side view of FIG. 10. In this particular configuration the stakes 24 and 25 may be either removed from the sections 14 and 18, respectively, or simply retained in their highest vertical position relative to the sections so that the pointed ends thereof are above the mat 32.

It will now be understood that what has been disclosed herein comprises an advantageous training device for use by golfers, the device of a configuration which makes it extremely convenient to carry and use. More specifically, the training device of the present invention is provided in a foldable configuration which is readily adapted for being placed inside a golf bag for convenience of carrying and is furthermore provided with an easily deployable means for securing the training device to the underlying surface whether that surface be a soft turf-like surface such as that found on the golf course or a hard rubber mat-like surface such as those found on practice facilities. The invention is configured in the form of three foldable sections interconnected by elongated hinge members which permit frequent folding and unfolding thereof. A strap is provided in a convenient location adhered to one of the sections for securing the training device in its folded configuration.

Those having skill in the art to which the present invention pertains will now, as a result of the applicant's herein, perceive various modifications and additions which may be made to the invention. By way of example, other folding section configurations may be provided as well as other means for securing the training device to the underlying surface, it being understood that a variety of other configurations are plausible for providing a planar or substantially planar surface against which the golfer may plant his load bearing leg during the golf stroke for advantageously limiting his body movement and thereby increasing the probability of properly impacting the ball with the face of the golf club head and thereby improving his overall performance in the game of golf. Accordingly, all such modifications and additions are deemed to be within the scope of the invention which is to be limited only by the claims appended hereto.

I claim:

1. A foldable golfer's training device adapted to be positioned on the ground adjacent the golfer's leg in the ball-addressing position and extending upward to permit engagement with the upper portion of the golfer's leg to limit leg motion by contact with the golfer's leg during a golf swing; the device comprising:

at least two elongated generally planar members interconnected along their respective edges by a plurality of hinge members to form a foldable planar structure, one of said planar members being shorter than the remaining member to preclude interference with the golf swing;

at least two pointed stakes secured to said planar members in spaced apart relation and moveable relative to said planar structure for penetration into the ground for securing said structure on the ground.

2. The training device recited in claim 1 further comprising a continuous aperture in said planar members, said aperture forming a notch when said device is folded whereby to provide a convenient means for grasping said device.

3. The training device recited in claim 1 further comprising means for securing said device in its folded configuration.

4. The training device recited in claim 1 further comprising a plurality of edge connecting brackets and a plurality of adjustable straps for connecting said device to an underlying mat.

5. The training device recited in claim 1 wherein each of said planar members is of substantially equal width and wherein said width is less than six inches.

6. The training device recited in claim 1 wherein there are at least three of said planar members and the common ends of at least two of said planar members are terminated along a continuous diagonal line for reducing the likelihood of interfering with the golfer's swing.

* * * * *